US007815064B2

(12) United States Patent
Howell et al.

(10) Patent No.: US 7,815,064 B2
(45) Date of Patent: Oct. 19, 2010

(54) PLASTIC CONTAINER HAVING WAVY VACUUM PANELS

(75) Inventors: Justin Howell, New Cumberland, PA (US); Luis Carvallo, York, PA (US)

(73) Assignee: Graham Packaging Company, L.P., York, PA (US)

( * ) Notice: Subject to any disclaimer, the term of this patent is extended or adjusted under 35 U.S.C. 154(b) by 1150 days.

(21) Appl. No.: 11/411,916

(22) Filed: Apr. 27, 2006

(65) Prior Publication Data

US 2007/0257004 A1 Nov. 8, 2007

(51) Int. Cl.
*B65D 90/02* (2006.01)

(52) U.S. Cl. ..... 215/381; 215/382; 215/384; 220/669

(58) Field of Classification Search ..... 215/381–384; 220/669, 673

See application file for complete search history.

(56) References Cited

U.S. PATENT DOCUMENTS

| | | | | | |
|---|---|---|---|---|---|
| 1,636,174 | A * | 7/1927 | Dolan et al. | ..... | 215/384 |
| D98,504 | S * | 2/1936 | Ennever | ..... | D9/541 |
| 4,497,855 | A * | 2/1985 | Agrawal et al. | ..... | 428/36.92 |
| 4,512,490 | A * | 4/1985 | Frei et al. | ..... | 220/673 |
| 5,746,339 | A * | 5/1998 | Petre et al. | ..... | 215/383 |
| D411,740 | S * | 6/1999 | Kim | ..... | D9/658 |
| D442,493 | S * | 5/2001 | Bretz et al. | ..... | D9/538 |
| D462,271 | S * | 9/2002 | Bourque et al. | ..... | D9/539 |
| 6,662,960 | B2 * | 12/2003 | Hong et al. | ..... | 215/381 |
| 6,763,969 | B1 * | 7/2004 | Melrose et al. | ..... | 220/669 |
| 6,779,673 | B2 * | 8/2004 | Melrose et al. | ..... | 215/381 |
| 6,796,450 | B2 * | 9/2004 | Prevot et al. | ..... | 215/381 |
| 6,923,334 | B2 * | 8/2005 | Melrose et al. | ..... | 215/381 |
| 6,929,138 | B2 * | 8/2005 | Melrose et al. | ..... | 215/381 |
| 6,938,788 | B2 * | 9/2005 | White | ..... | 215/384 |
| D515,430 | S * | 2/2006 | Venkataraman et al. | ..... | D9/538 |
| 7,172,087 | B1 * | 2/2007 | Axe et al. | ..... | 215/382 |
| D543,116 | S * | 5/2007 | Heisner | ..... | D9/540 |
| D557,609 | S * | 12/2007 | Ungrady et al. | ..... | D9/538 |
| 7,377,399 | B2 * | 5/2008 | Lane et al. | ..... | 215/381 |
| 2003/0010743 | A1 * | 1/2003 | Boukobza | ..... | 215/382 |
| 2003/0015491 | A1 * | 1/2003 | Melrose et al. | ..... | 215/381 |
| 2004/0164047 | A1 * | 8/2004 | White | ..... | 215/384 |
| 2004/0211746 | A1 * | 10/2004 | Trude | ..... | 215/374 |
| 2005/0067369 | A1 * | 3/2005 | Trude | ..... | 215/381 |

FOREIGN PATENT DOCUMENTS

| | | |
|---|---|---|
| WO | WO 00/50309 | 8/2000 |

* cited by examiner

*Primary Examiner*—Anthony Stashick
*Assistant Examiner*—Ned A Walker
(74) *Attorney, Agent, or Firm*—Knoble Yoshida & Dunleavy, LLC

(57) ABSTRACT

A plastic container comprises an upper portion including a finish, a lower portion including a base, a sidewall extending between the upper portion and the lower portion, the sidewall defining a central longitudinal axis of the container, and at least two vacuum panels located in the sidewall and separated by a substantially longitudinal rib having a wavy longitudinal profile. Each vacuum panel comprises a first portion having a first cross-section in a plane substantially transverse to the longitudinal axis, and a second portion having a second cross-section in a plane substantially transverse to the longitudinal axis, the second cross-section being arced to a greater extent than the first cross-section.

16 Claims, 6 Drawing Sheets

PLASTIC CONTAINER HAVING WAVY VACUUM PANELS

BACKGROUND OF THE INVENTION

1. Field of the Invention

The present invention relates generally to plastic containers, and more particularly, to hot-fill plastic containers having improved vacuum panels to provide uniform deformation of the container sidewall under hot-fill conditions.

2. Related Art

With hot-fill plastic containers, the container is typically filled with hot fluid product and capped while the fluid product is still hot. As the fluid product cools, a reduction in fluid volume occurs, and typically creates a vacuum within the container (i.e., an internal pressure within the container that is less than the surrounding atmospheric pressure). With certain prior art configurations, the vacuum forces inside the container can cause uneven vacuum absorption and/or uneven deformation of the container. This can undesirably affect the appearance, strength, shelf life, and/or other characteristics of the container. Therefore, there remains a need in the art for a hot-fill plastic container that overcomes the shortcomings of the prior art.

BRIEF SUMMARY OF THE INVENTION

According to an exemplary embodiment, the present invention relates to a plastic container comprising an upper portion including a finish, a lower portion including a base, a sidewall extending between the upper portion and the lower portion, with the sidewall defining a central longitudinal axis of the container, and at least two vacuum panels located in the sidewall and separated by a substantially longitudinal rib having a wavy longitudinal profile. Each vacuum panel can comprise a first portion having a first cross-section in a plane substantially transverse to the longitudinal axis, and a second portion having a second cross-section in a plane substantially transverse to the longitudinal axis, the second cross-section being arced to a greater extent than the first cross-section.

According to another exemplary embodiment, the present invention relates to a plastic container comprising an upper portion including a finish, a lower portion including a base, a sidewall extending between the upper portion and the lower portion, with the sidewall defining a central longitudinal axis of the container, and at least one vacuum panel located in the sidewall, the vacuum panel defined by left and right borders that are wavy in shape. The vacuum panel can comprise a first portion having a first cross-section in a plane substantially transverse to the longitudinal axis, and a second portion having a second cross-section in a plane substantially transverse to the longitudinal axis, the second cross-section being arced to a greater extent than the first cross-section.

The present invention also relates to methods of blow molding a plastic container. According to one exemplary embodiment, the method comprises forming an upper portion, forming a lower portion including a base, forming a sidewall extending between the upper portion and the lower portion, the sidewall defining a central longitudinal axis of the container, and forming at least two vacuum panels located in the sidewall and separated by a substantially longitudinal rib having a wavy longitudinal profile. Each vacuum panel can comprise a first portion having a first cross-section in a plane substantially transverse to the longitudinal axis, and a second portion having a second cross-section in a plane substantially transverse to the longitudinal axis, the second cross-section being arced to a greater extent than the first cross-section.

According to another exemplary embodiment, the method comprises forming an upper portion, forming a lower portion including a base, forming a sidewall extending between the upper portion and the lower portion, the sidewall defining a central longitudinal axis of the container, and forming at least one vacuum panel in the sidewall, the vacuum panel defined by left and right borders that are wavy in shape. The vacuum panel can comprise a first portion having a first cross-section in a plane substantially transverse to the longitudinal axis, and a second portion having a second cross-section in a plane substantially transverse to the longitudinal axis, the second cross-section being arced to a greater extent than the first cross-section.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings, wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without departing from the spirit and scope of the invention. All references cited herein are incorporated by reference as if each had been individually incorporated.

Figure 1:
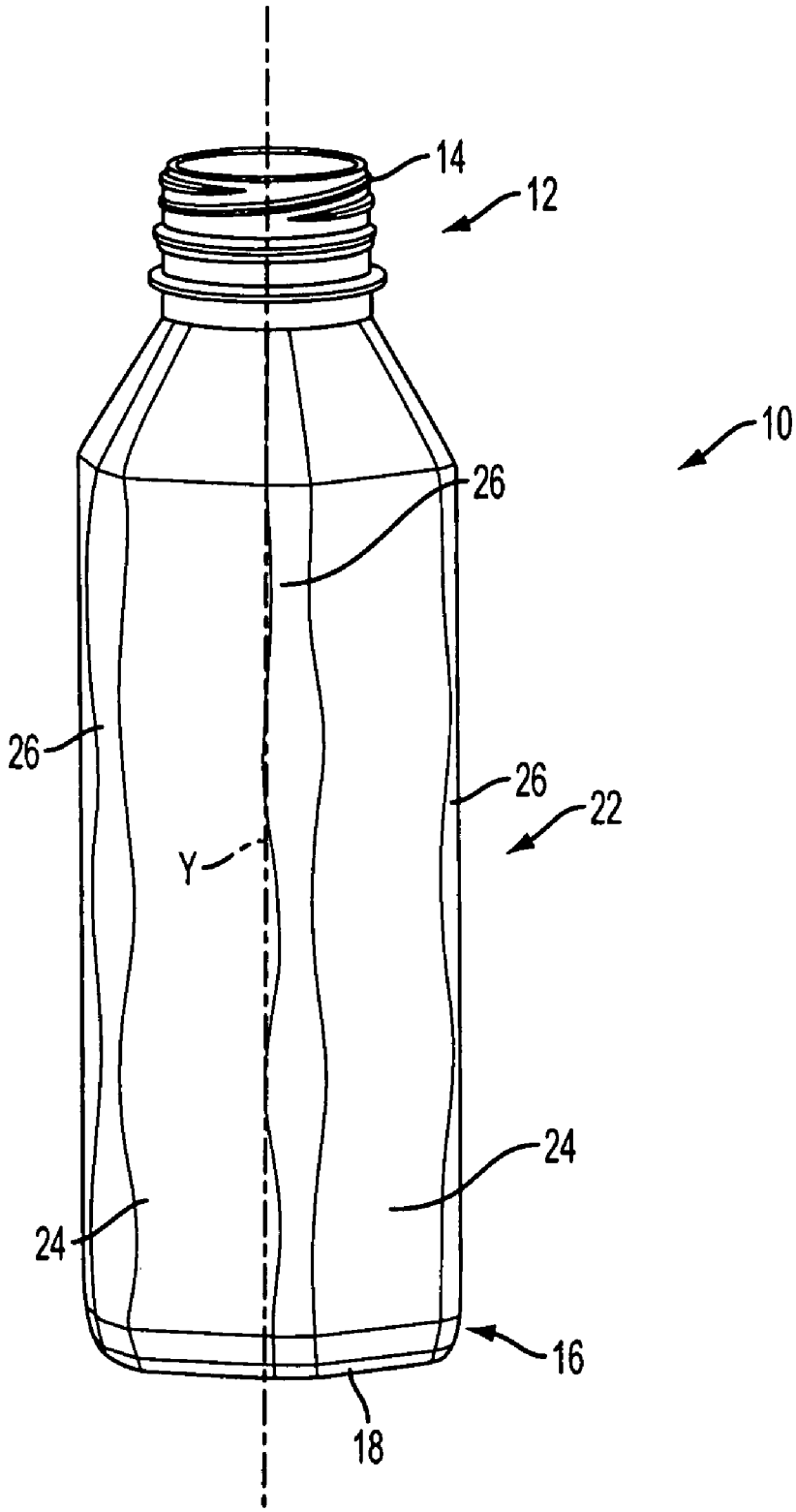
FIG. 1 is a perspective view of an exemplary plastic container according to the present invention.

Referring to FIG. 1, an exemplary container 10 according to the present invention is shown. The container 10 can be used to package a wide variety of liquid, viscous, or solid products including, for example, juices, other beverages, yogurt, sauces, pudding, lotions, soaps in liquid or gel form, and bead shaped objects such as candy.

Container 10 is preferably able to withstand the rigors of hot-fill processing. In a hot fill process, a product is added to the container at an elevated temperature, typically about 82° C., which can be near the glass transition temperature of the plastic material, and the container is capped. As the container and its contents cool, the contents tend to contract and this volumetric change creates a partial vacuum within the container. In the absence of some means for accommodating these internal volumetric and barometric changes, containers tend to deform and/or collapse. For example, a round container can undergo ovalization, or tend to distort and become out of round. Containers of other shapes can become similarly distorted. In addition to these changes that adversely affect the appearance of the container, distortion or deformation can cause the container to lean or become unstable. This is particularly true where deformation of the base region occurs. As described in more detail below, container 10 can include vacuum panels and/or other features that help overcome, or withstand, these tendencies.

Figure 3:
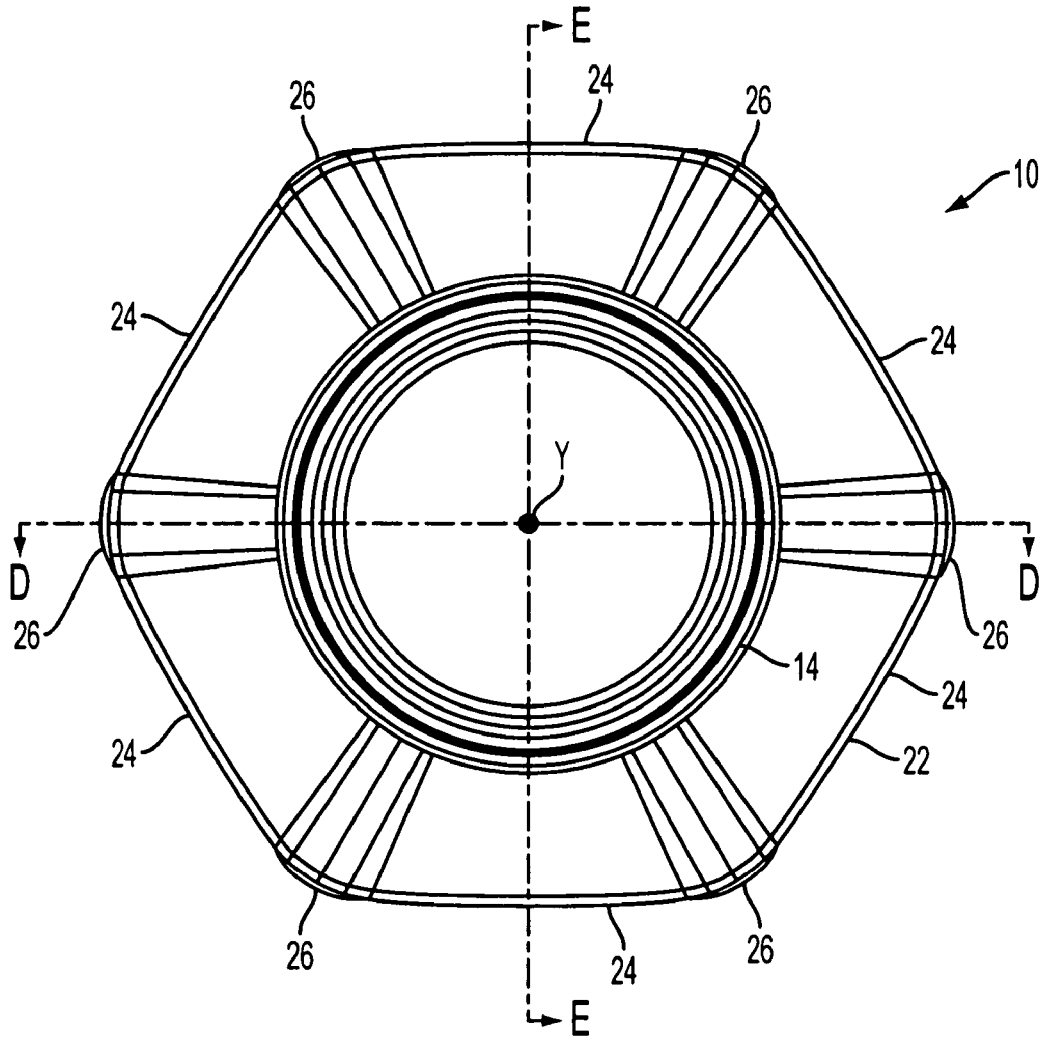
FIG. 3 is a top view of the container of FIG. 1.
Figure 4:
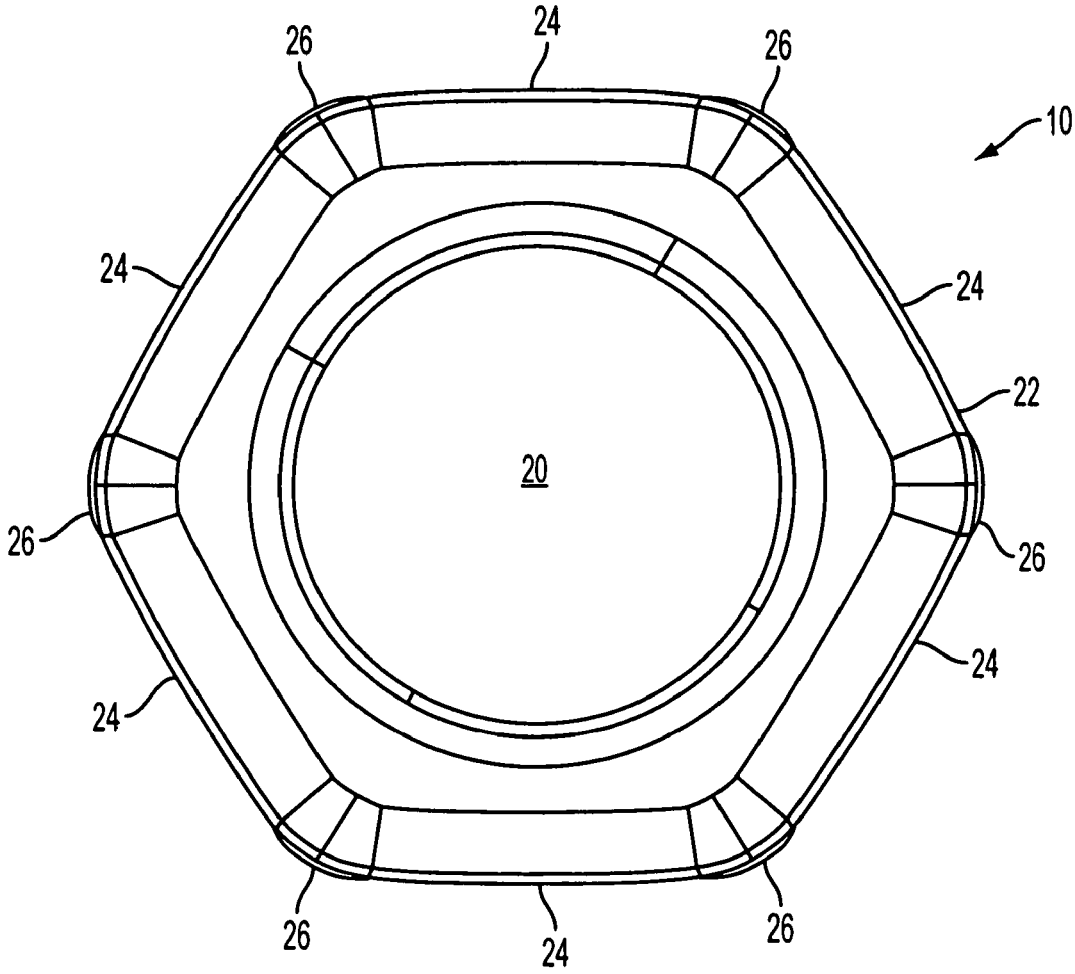
FIG. 4 is a bottom view of the container of FIG. 1.

As shown in FIG. 1, container 10 includes an upper portion 12 that can include a finish 14. Finish 14 can be threaded or otherwise adapted to secure a closure, such as a cap (not shown), to the container 10. Container 10 also includes a lower portion 16 that can include a base 18. Base 18 can be adapted to support container 10 in an upright position, for example, on a flat or relatively flat surface. Base 18 can include various structures that reinforce the base 18 and/or container 10, and/or structures that enhance the ability of container 10 to withstand vacuum forces. For example, as shown in FIG. 4, base 18 can include an invertible pressure panel 20 that is adapted to absorb at least a portion of the vacuum forces that develop inside the container 10 during the hot-fill process. Container 10 also includes a sidewall 22 that extends partially or completely between the upper portion 12 and the lower portion 16. The sidewall 22 can extend around and/or define a central longitudinal axis Y of container 10. Axis Y is also depicted in FIGS. 2 and 3.

Referring to FIGS. 1-4, container 10 can include one or more vacuum panels 24 that are located in the sidewall 22. In the exemplary embodiment shown, container 10 has six vacuum panels 24, however, other numbers and arrangements of vacuum panels are possible, such as three, four, or five. Container 10 can also include a plurality of longitudinal ribs 26 located in the sidewall 22. As shown, a rib 26 can be located between each adjacent pair of vacuum panels 24. For example, in the exemplary embodiment shown in FIGS. 1-4, container 10 includes six vacuum panels 24 arranged in alternating order with six longitudinal ribs 26, however, other arrangements of vacuum panels and ribs are possible. The vacuum panels 24 are configured to flex inward to compensate for vacuum forces that develop inside the container 10 as a result of hot-fill processing.

Figure 2A:
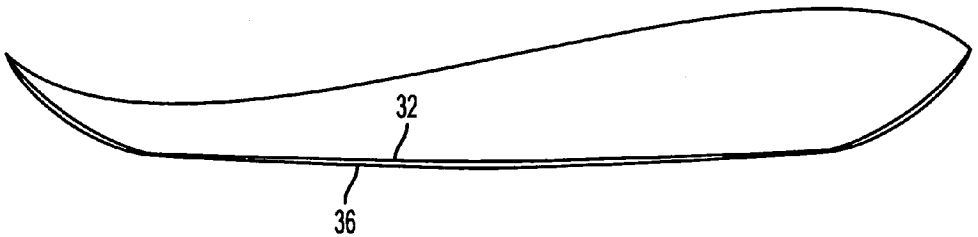
FIG. 2A depicts cross-sections taken through a portion of the sidewall of the container of FIG. 2, along lines A-A, B-B, and C-C.
Figure 2:
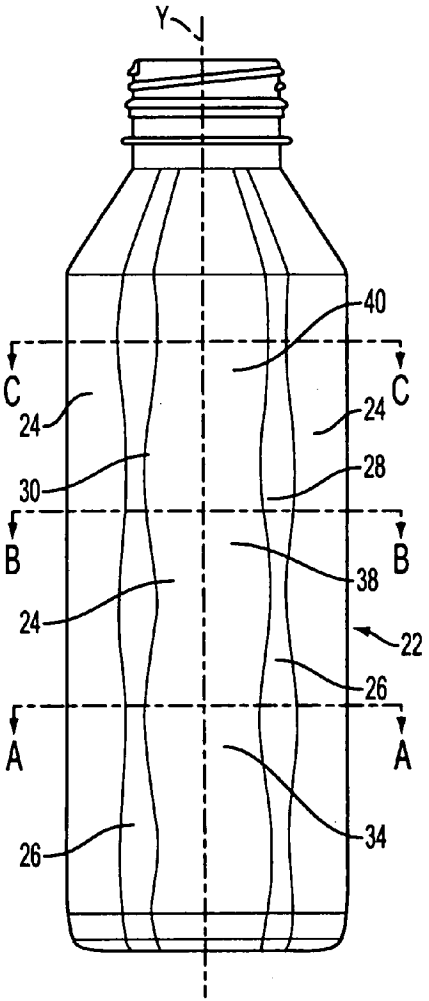
FIG. 2 is a side view of the container of FIG. 1.
Figure 5:
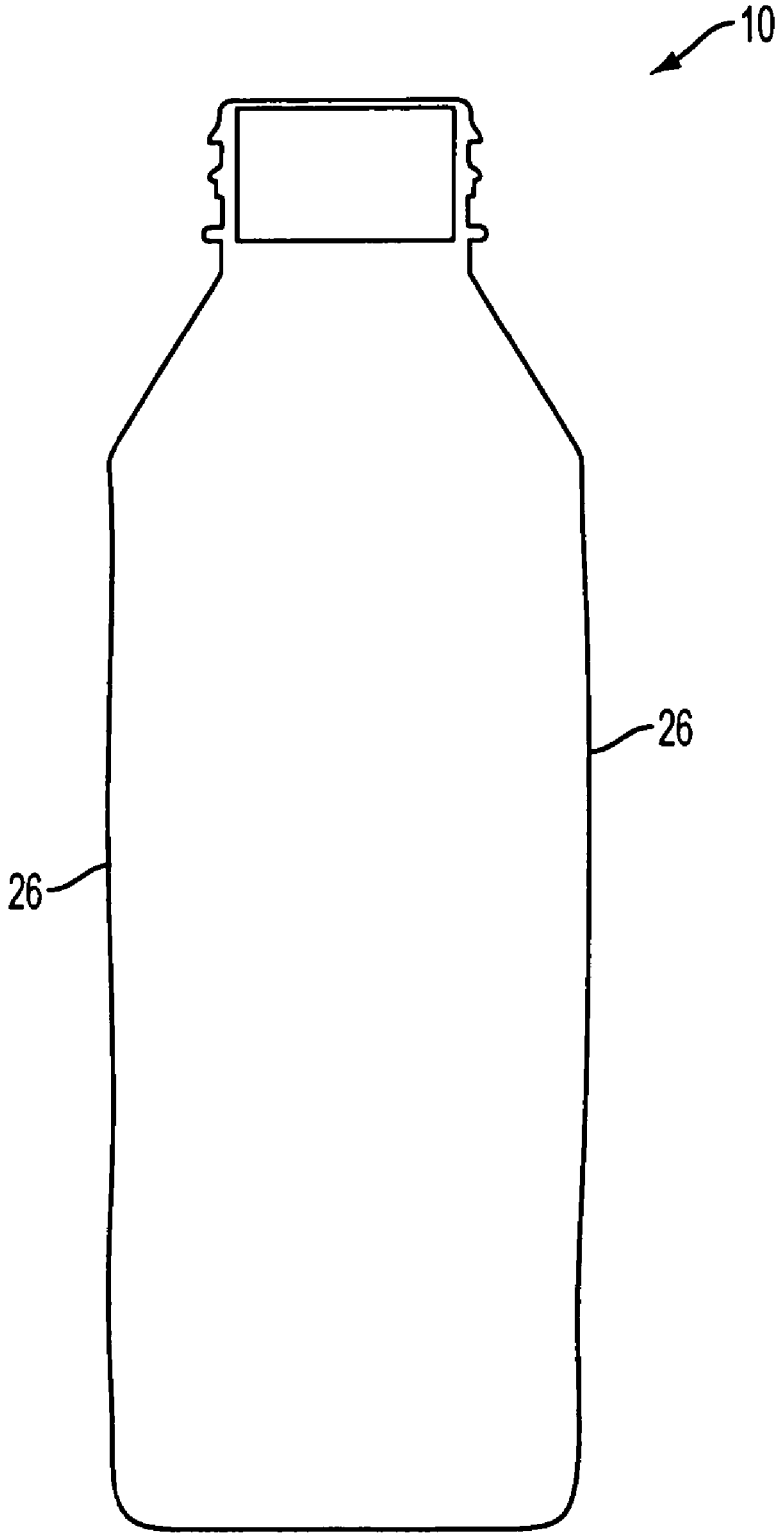
FIG. 5 is a cross-sectional view of the container of FIG. 1, taken along line D-D of FIG. 3.
Figure 6:
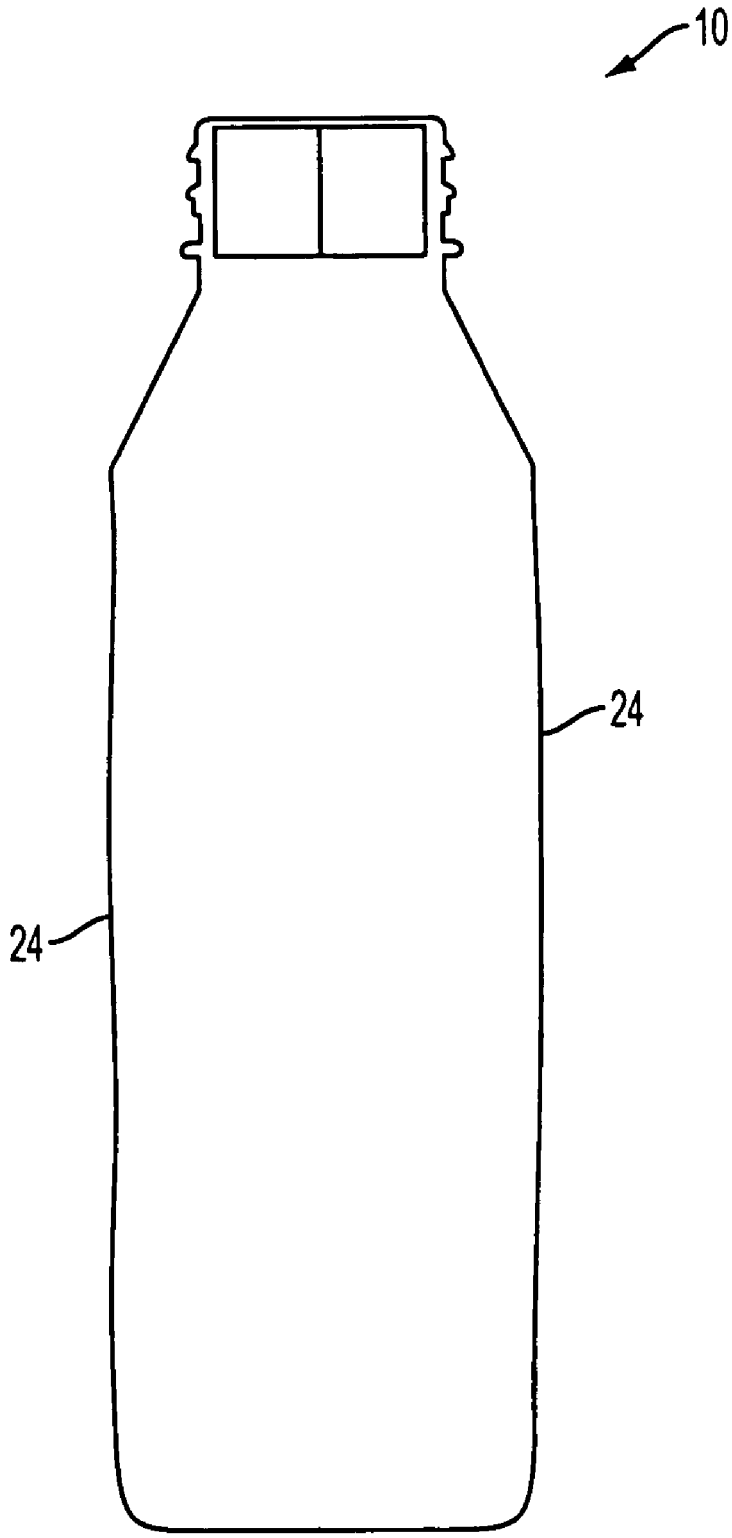
FIG. 6 is a cross-sectional view of the container of FIG. 1, taken along line E-E of FIG. 3.

As best shown in FIGS. 2 and 5, one or more of the longitudinal ribs 26 can have a wavy longitudinal profile. For example, the longitudinal profile of the ribs 26 can be wavy from side-to-side, as shown in FIG. 2. Additionally or alternatively, the longitudinal profile of the ribs 26 can be wavy from front-to-back, as shown in the cross-sectional view of FIG. 5. According to one exemplary embodiment, the waviness of the longitudinal ribs 26 is substantially sinusoidal, as shown. FIG. 6 is a cross-sectional view through two opposed vacuum panels 24, described in more detail below. In comparison to the longitudinal ribs 26, the vacuum panels 24 can have relatively flat longitudinal profiles, however, other configurations are possible.

Referring to FIG. 2, one or more of the vacuum panels 24 can have right and left longitudinal borders 28, 30 that are wavy, for example, sinusoidal, in shape. The longitudinal borders 28, 30 can be defined by the adjacent longitudinal ribs 26, or alternatively, by other structures located in the container sidewall 22. Still referring to FIG. 2, the left and right borders 28, 30 can have substantially complementary geometries, such as the complementary, sinusoidal, longitudinal profiles shown. The complementary, wavy profiles of the borders 28, 30 have been found to provide a container sidewall 10 that absorbs vacuum and/or deforms more evenly under hot-fill conditions.

Referring to FIGS. 2 and 2A, one or more of the vacuum panels 24 can have a portion with a decreased, or flattened, radius of curvature. For example, line 32 in FIG. 2A represents the transverse cross-section of a first portion 34 of vacuum panel 24 when viewed along line A-A of FIG. 2. Line 36 represents the transverse cross-section of a second portion 38 of vacuum panel 24 when viewed along line B-B of FIG. 2. Line 36 also represents the transverse cross-section of a third portion 40 of vacuum panel 24 when viewed along line C-C of FIG. 2. According to the exemplary embodiment show, the transverse radius of curvature stays relatively constant between points C-C and B-B, and gradually decreases (or flattens out) between points B-B and A-A. While the transverse cross-sections through lines B-B and C-C (i.e., at the second and third sections 38, 40) are the same in the exemplary embodiment shown, one of ordinary skill in the art will understand that these cross-sections can alternatively be different from one another. For example, according to another exemplary embodiment, the transverse radius of curvature of the panel 24 can gradually increase from one end of the panel to the other. In the exemplary embodiment shown, the vacuum panel has cross-sections 32 and 36 that are arced away from the central longitudinal axis Y (i.e., outward with respect to the container 10), however, the cross-sections may alternatively be arced toward the central longitudinal axis (i.e., inward).

As can be seen in FIG. 2A, the second and third portions 38, 40 of the sidewall 24 can have a transverse radius of curvature 36 that is arced to a greater extent than the transverse radius of curvature 32 of the first portion 34. Due to its decreased radius of curvature 32 relative to the second and third portions 38, 40, the first portion 34 is more susceptible to vacuum forces inside the container 10 than are the second and third portions 38, 40. Thus, when the container 10 is subjected to internal vacuum forces, vacuum panel 24 may first begin to flex inward and/or invert at the first portion 34. This may pull the area adjacent to the first portion 34 inwards, and initiate inward flexing and/or inversion of the second and third portions 38, 40. As a result, deflection and/or inversion of the vacuum panel 24 occurs gradually from the first portion 34 to the second and third portions 38, 40 during cooling of the liquid contents of the container 10. This is in contrast to a panel that rapidly inverts or "flips" between two states. The gradual deflection and/or inversion of the vacuum panels 24 according to the present invention means that less force is transmitted to the container walls during cooling. This allows for less material to be used in the container construction. This also allows for the use of smaller vacuum panels 24, as even low vacuum forces will initiate deflection and/or inversion of the vacuum panels 24. In addition, multi-panel containers incorporating the wavy rib configuration and the above-described vacuum panel configuration have been found to deform more evenly from panel-to-panel as compared to some prior art containers.

It will be apparent to one of ordinary skill in the art that once internal vacuum pressure is removed from the container 10, for example, upon removing a cap from the container 10, the vacuum panels 24 may recover from the deflected/inverted position, and return to their original position.

The container 10 can have a one-piece construction and can be prepared from a monolayer plastic material, such as a polyamide, for example, nylon; a polyolefin such as polyethylene, for example, low density polyethylene (LDPE) or high density polyethylene (HDPE), or polypropylene; a polyester, for example, polyethylene terephthalate (PET), polyethylene naphtalate (PEN); or others, which can also include additives to vary the physical or chemical properties of the material. For example, some plastic resins can be modified to improve the oxygen permeability. Alternatively, the container can be prepared from a multilayer plastic material. The layers can be any plastic material, including virgin, recycled, and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. In an exemplary embodiment, the present container is prepared from PET.

The present container can be made by conventional blow molding processes including, for example, extrusion blow molding, stretch blow molding, and injection blow molding.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A plastic container comprising:

an upper portion including a finish;

a lower portion including a base;

a sidewall extending between the upper portion and the lower portion, the sidewall defining a central longitudinal axis of the container;

at least two vacuum panels located in the sidewall and separated by a substantially longitudinal rib having a wavy longitudinal profile, each vacuum panel comprising a first portion having a first cross-section in a plane substantially transverse to the longitudinal axis, and a second portion having a second cross-section in a plane substantially transverse to the longitudinal axis, the second cross-section being arced to a greater extent than the first cross-section; and wherein at least one of the vacuum panels has left and right longitudinal borders that are wavy and have substantially complementary geometries disposed laterally opposite one another throughout.

2. The plastic container of claim 1, wherein the rib has a substantially sinusoidal longitudinal profile.

3. The plastic container of claim 1, wherein the left and right borders are substantially sinusoidal in shape.

4. The plastic container of claim 1, comprising six vacuum panels separated by six substantially longitudinal ribs.

5. The plastic container of claim 1, wherein the first cross-section is arced away from the central longitudinal axis.

6. The plastic container of claim 5, wherein the second cross-section is arced away from the central longitudinal axis to a greater extent that the first cross-section.

7. A plastic container comprising:

an upper portion including a finish;

a lower portion including a base;

a sidewall extending between the upper portion and the lower portion, the sidewall defining a central longitudinal axis of the container; and at least one vacuum panel located in the sidewall, the vacuum panel defined by left and right borders that are wavy in shape, and have substantially complementary geometries disposed laterally opposite one another throughout, and a substantially longitudinal rib having a wavy longitudinal profile located adjacent the vacuum panel, the vacuum panel comprising a first portion having a first cross-section in a plane substantially transverse to the longitudinal axis, and a second portion having a second cross-section in a plane substantially transverse to the longitudinal axis, the second cross-section being arced to a greater extent than the first cross-section.

8. The plastic container of claim 7, wherein the left and right borders are substantially sinusoidal in shape.

9. The plastic container of claim 7, further comprising:

a plurality of the vacuum panels located around the sidewall; and a substantially longitudinal rib located between each adjacent pair of the vacuum panels.

10. The plastic container of claim 7, wherein the substantially longitudinal rib has a substantially sinusoidal longitudinal profile.

11. The plastic container of claim 7, wherein the first cross-section is arced away from the central longitudinal axis.

12. The plastic container of claim 11, wherein the second cross-section is arced away from the central longitudinal axis to a greater extent than the first cross-section.

13. A method of blow molding a plastic container, comprising:

(a) forming an upper portion;

(b) forming a lower portion including a base;

(c) forming a sidewall extending between the upper portion and the lower portion, the sidewall defining a central longitudinal axis of the container;

(d) forming at least two vacuum panels located in the sidewall and separated by a substantially longitudinal rib having a wavy longitudinal profile, each vacuum panel comprising a first portion having a first cross-section in a plane substantially transverse to the longitudinal axis, and a second portion having a second cross-section in a plane substantially transverse to the longitudinal axis, the second cross-section being arced to a greater extent than the first cross-section; and wherein the at least two vacuum panels are defined by left and right borders that are wavy in shape and have substantially complementary geometries disposed laterally opposite one another throughout.

14. The method of claim 13, further comprising the step of forming a finish on the upper portion of the container.

15. A method of blow molding a plastic container, comprising:

(a) forming an upper portion;

(b) forming a lower portion including a base;

(c) forming a sidewall extending between the upper portion and the lower portion, the sidewall defining a central longitudinal axis of the container; and (d) forming at least one vacuum panel in the sidewall, the vacuum panel defined by left and right borders that are wavy in shape and have substantially complementary geometries disposed laterally opposite one another throughout, and a substantially longitudinal rib having a wavy longitudinal profile located adjacent the vacuum panel, the vacuum panel comprising a first portion having a first cross-section in a plane substantially transverse to the longitudinal axis, and a second portion having a second cross-section in a plane substantially transverse to the longitudinal axis, the second cross-section being arced to a greater extent than the first cross-section.

16. The method of claim 15, further comprising the step of forming a finish on the upper portion of the container.

* * * * *